US009315035B2

(12) United States Patent
Maruyama et al.

(10) Patent No.: US 9,315,035 B2
(45) Date of Patent: Apr. 19, 2016

(54) LIQUID CONTAINER RETAINING UNIT AND LIQUID EJECTING APPARATUS

(71) Applicant: SEIKO EPSON CORPORATION, Tokyo (JP)

(72) Inventors: Akihiko Maruyama, Matsumoto (JP); Yuji Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/108,975

(22) Filed: Dec. 17, 2013

(65) Prior Publication Data

US 2014/0176650 A1 Jun. 26, 2014

(30) Foreign Application Priority Data

Dec. 25, 2012 (JP) ..... 2012-281572

(51) Int. Cl.
*B41J 2/175* (2006.01)

(52) U.S. Cl.
CPC ..... *B41J 2/1752* (2013.01); *B41J 2/1753* (2013.01); *B41J 2/17513* (2013.01); *B41J 2/17546* (2013.01); *B41J 2/17553* (2013.01)

(58) Field of Classification Search
None
See application file for complete search history.

(56) References Cited

U.S. PATENT DOCUMENTS

| | | | | |
|---|---|---|---|---|
| 6,074,042 | A * | 6/2000 | Gasvoda et al. | 347/50 |
| 6,179,415 | B1 | 1/2001 | Okazaki et al. | |
| 7,213,914 | B2 | 5/2007 | Anma et al. | |
| 7,717,541 | B2 | 5/2010 | Shimizu et al. | |
| 7,806,523 | B2 | 10/2010 | Seino et al. | |
| 7,954,931 | B2 | 6/2011 | Shimizu et al. | |
| 8,086,129 | B2 | 12/2011 | Nishimoto | |
| 8,091,995 | B2 | 1/2012 | Shimizu et al. | |
| 8,091,998 | B2 | 1/2012 | Anma et al. | |
| 8,136,930 | B2 | 3/2012 | Anma et al. | |
| 8,141,998 | B2 | 3/2012 | Nozawa et al. | |
| 8,297,738 | B1 * | 10/2012 | Kodama et al. | 347/49 |
| 8,376,535 | B2 | 2/2013 | Shimizu et al. | |
| 2005/0052511 | A1 | 3/2005 | Seino et al. | |
| 2009/0196647 | A1 * | 8/2009 | Nishimoto | 399/90 |
| 2012/0056955 | A1 | 3/2012 | Kodama et al. | |
| 2012/0056958 | A1 | 3/2012 | Nozawa et al. | |
| 2012/0127247 | A1 | 5/2012 | Anma et al. | |
| 2012/0293591 | A1 | 11/2012 | Shimizu et al. | |

FOREIGN PATENT DOCUMENTS

| | | |
|---|---|---|
| JP | 07-108688 | 4/1995 |
| JP | 2005-271518 | 10/2005 |
| JP | 2007-230249 | 9/2007 |
| JP | 2008-137376 | 6/2008 |

(Continued)

*Primary Examiner* — Bradley Thies
(74) *Attorney, Agent, or Firm* — Workman Nydegger

(57) ABSTRACT

A liquid container retaining unit includes: a first urging member for generating, in relation to the insertion of a liquid container into the container retaining element, an urging force to urge the liquid container in a removal direction; a container retaining mechanism for releasing the liquid container from a restricted state by moving the liquid container retained in the restricted state in the insertion direction so that the urging force of the first urging member is capable of moving the liquid container in the removal direction; a second urging member for generating, when the liquid container is retained within the container retaining element in the restricted state, an urging force to urge so as to cause the first electrodes on the liquid container and the second electrodes on the container retaining element to abut against each other.

6 Claims, 12 Drawing Sheets

(56) References Cited

FOREIGN PATENT DOCUMENTS

| | | |
|---|---|---|
| JP | 2009-211054 | 9/2009 |
| JP | 2011-235652 | 11/2011 |
| JP | 2012-030366 | 2/2012 |
| JP | 2012-051313 | 3/2012 |
| JP | 2012-051315 | 3/2012 |

* cited by examiner

LIQUID CONTAINER RETAINING UNIT AND LIQUID EJECTING APPARATUS

BACKGROUND

1. Technical Field

The present invention relates to a liquid container retaining unit for retaining a liquid container capable of storing a liquid, and a liquid ejecting apparatus including the liquid container retaining unit.

2. Related Art

An example of a known liquid ejecting apparatus is an ink jet printer in which a liquid stored in a liquid container is supplied to a liquid ejecting head from which the liquid is ejected onto printing media, such as paper sheets or the like, to form an image or the like. Such a printer typically includes a liquid container retaining unit having a container retaining element for retaining a plurality of liquid containers in an insertable and removable manner. Then, in the printer, for image formation, liquids are supplied from the liquid containers retained in the container retaining element of the liquid container retaining unit to the liquid ejecting head, and after completion of the image formation, data such as the amount of liquid remaining in each of the liquid containers or the like is stored in a memory disposed in the respective liquid containers.

That is, for each of the liquid containers, first electrodes to be electrically connected to the memory disposed in the liquid container are disposed on the liquid container while second electrodes capable of being electrically connected to the first electrodes on the liquid container are disposed on the container retaining element. Then, data which is to be stored after supply of the liquid into the liquid ejecting head is transferred via the second electrodes disposed on the container retaining element to the first electrodes electrically connected to the second electrodes, and the transferred data is stored in the memory disposed in the liquid container.

The following configuration is known as an example of such a liquid container retaining unit. That is, in such a liquid container retaining unit, a liquid container (cartridge) which is inserted into a container retaining element (holder) includes: a circuit board having first electrodes (terminal board) and a memory on the outer surface of an inclined wall; and an urging member (lever) which elastically deforms. Then, with the urging force (elastic force) of the urging member which elastically deforms with the insertion of the liquid container into the container retaining element, the liquid container is mounted (fixed) in the container retaining element, and when being mounted, the second electrodes (contact mechanism) arranged on the container retaining element are electrically connected to the first electrodes (for example, see JP-A-2012-051315).

However, the urging force generated by elastic deformation of an urging member when the liquid container is mounted on the container retaining element can deform the container retaining element and the liquid container having been mounted can become tilted within the container retaining element due to the container being urged in one direction by a single urging member. In this case, the first electrodes on the liquid container and the second electrodes on the container retaining element (contact mechanism) are relatively misaligned with respect to each other, so that the first electrodes and the second electrodes cannot be electrically connected to each other. As a result, data cannot be properly stored in the memory.

Moreover, this type of situation is common, not only among ink jet printers, but also among liquid container retaining units for retaining liquid containers and liquid ejecting apparatuses including such a liquid container retaining unit and including a liquid ejecting head for ejecting a liquid supplied from the liquid containers.

SUMMARY

An advantage of some aspects of the invention is to provide a liquid container retaining unit which is capable of increasing the reliability of electrical connection between first electrodes on a liquid container and second electrodes in a container retaining element, and a liquid ejecting apparatus including the liquid container retaining unit.

A means and its effect for solving the above problems will be described below.

The liquid container retaining unit that is to solve the above problems includes a container retaining element for retaining a liquid container having first electrodes in an insertable and removable manner, the container retaining element having second electrodes that are capable of being abutted against the first electrodes. The liquid container retaining unit further includes a first urging member for generating, in relation to the insertion of the liquid container into the container retaining element, an urging force to urge the liquid container in a removal direction opposite to an insertion direction in which the liquid container is inserted into the container retaining element. The liquid container retaining unit further includes a container retaining mechanism for retaining the liquid container inserted into the container retaining element in a restricted state in which movement of the liquid container in the removal direction by the urging force of the first urging member is restricted, and for releasing the liquid container from the restricted state by moving the liquid container retained in the restricted state in the insertion direction so that the urging force of the first urging member is capable of moving the liquid container in the removal direction. The liquid container retaining unit further includes a second urging member for generating, when the liquid container is retained within the container retaining element in the restricted state, an urging force to urge the second electrodes so as to cause the first electrodes on the liquid container and the second electrodes on the container retaining element to abut against each other.

According to this configuration, for example, even if a reaction force against the urging force of the first urging member generated with the insertion of the liquid container deforms the container retaining element, the urging force by the second urging member causes the second electrodes on the container retaining element to abut against the first electrodes on the liquid container without being affected by the deformation of the container retaining element. Therefore, this can increase the reliability of the electrical connection between the first electrodes and the second electrodes.

Preferably, the above liquid container retaining unit further includes a movable member which is movably arranged in the container retaining element and has an opposing surface facing the first electrodes arranged on the liquid container when the liquid container has been inserted. The second electrodes are arranged on the opposing surface of the movable member and the second urging member urges the movable member in a direction such that the opposing surface moves toward the first electrodes of the liquid container having been inserted into the container retaining element.

According to this configuration, when the second electrodes are disposed on the opposing surface of the movable member movably arranged in the container retaining element and the liquid container is inserted into the container retaining element, the second urging member urges the movable member in a direction so that the opposing surface moves toward the first electrodes of the liquid container. Therefore, regardless of the presence or absence of deformation of the container retaining element by a reaction force against the urging force of the first urging member, the second electrodes arranged on the opposing surface of the movable member abut against the first electrodes with the second electrodes being urged by the second urging member, which can increase the reliability of the electrical connection between the first electrodes and the second electrodes.

Preferably, the above liquid container retaining unit includes the container retaining element including the sliding mechanism for sliding the movable member in a direction parallel to the insertion direction of the liquid container.

According to this configuration, the sliding mechanism slides the movable member in a direction parallel to the insertion direction of the liquid container, thereby obtaining consistent positional accuracy between the first electrodes and the second electrodes, which can increase the reliability of the electrical connection between the first electrodes and the second electrodes.

Preferably, in the above liquid container retaining unit, the liquid container has an inclined surface which is inclined so that it intersects the insertion direction in which the liquid container is inserted into the container retaining element; and the first electrodes are arranged on the inclined surface.

According to this configuration, the second electrodes on the container retaining element to abut against the first electrodes arranged on the inclined surface of the liquid container to be inserted may be moved relative to the first electrodes along the inclined surface while being pressed perpendicularly to the inclined surface. Therefore, the relative movement of the liquid container while being pressed can increase the reliability of the electrical connection between the first electrodes and the second electrodes.

Preferably, in the above liquid container retaining unit, the second urging member generates an urging force against the second electrodes after the urging force of the first urging member has been generated with the insertion of the liquid container into the container retaining element.

According to this configuration, when the liquid container is inserted into the container retaining element, after the liquid container is urged by the urging force of the first urging member in the removal direction, the urging force of the second urging member urges the second electrodes so as to cause the second electrodes to abut against the first electrodes. Therefore, for example, because a user presses the liquid container into the container retaining element against the urging force so that the first electrodes and the second electrodes are electrically connected to each other, the first electrodes and the second electrodes may be inhibited from accidentally electrically connecting to each other when the liquid container is inserted into the container retaining element.

Preferably, in the above liquid container retaining unit, the movement distance of the liquid container in the removal direction over which the urging force of the first urging member urges the liquid container is larger than the movement distance of the liquid container in the removal direction over which the urging force of the second urging member urges the second electrodes.

According to this configuration, within the movement range of the liquid container in the removal direction where the first urging member urges the liquid container when the liquid container is removed, the second urging member may be in a state in which it does not urge the second electrodes against the first electrodes. Therefore, for example, while the liquid container moves due to the urging force of the first urging member in the removal direction, the first electrodes and the second electrodes may be electrically disconnected.

A liquid ejecting apparatus to solve the above problems includes: a liquid container retaining unit having the above configuration; and a liquid ejecting head being capable of ejecting a liquid supplied from the liquid container retained in the liquid container retaining unit.

According to this configuration, for example, even if a reaction force against the urging force of the first urging member generated in relation to the insertion of the liquid container deforms the container retaining element, a liquid ejecting apparatus may be obtained which increases the reliability of the electrical connection between the first electrodes and the second electrodes without being affected by the deformation of the container retaining element.

BRIEF DESCRIPTION OF THE DRAWINGS

The invention will be described with reference to the accompanying drawings, wherein like numbers reference like elements.

DESCRIPTION OF EXEMPLARY EMBODIMENTS

One embodiment of an ink jet printer (hereinafter also referred to as "printer") as an example of a liquid ejecting apparatus which includes a liquid container retaining unit and ejects liquids supplied from liquid containers retained in the liquid container retaining unit will be described below with reference to the drawings.

Figure 1:
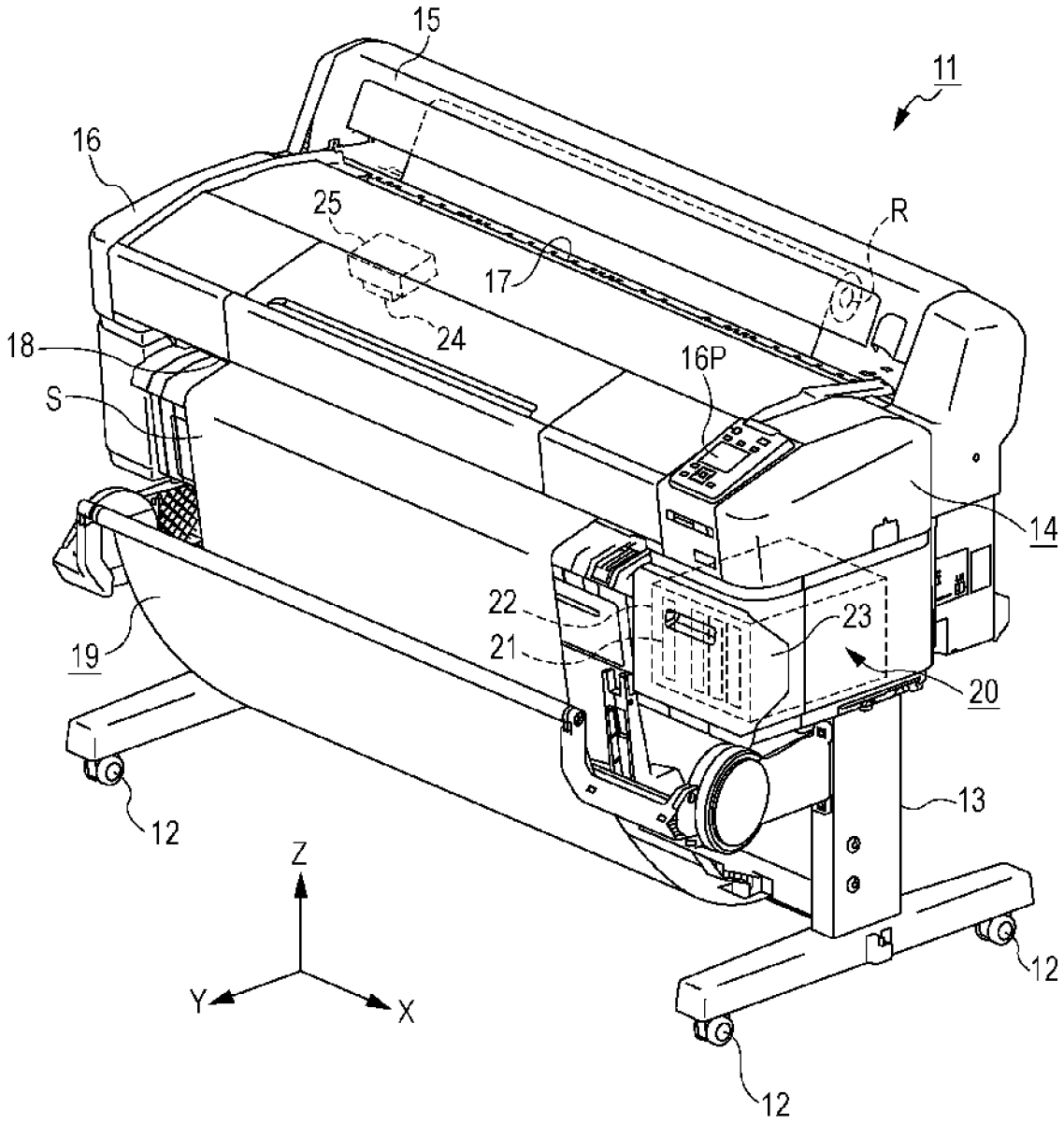
FIG. 1 is a schematic perspective view showing one embodiment of a printer as an example of a liquid ejecting apparatus.

As shown in FIG. 1, a printer 11 of the embodiment includes: leg portions 13, each having wheels 12 attached at the bottom end; and an apparatus body 14 having a substantially rectangular parallelepiped shape having a longitudinal direction and having the leg portions 13 assembled at the two ends thereof. Moreover, in the embodiment, the vertical direction is an up-and-down direction Z, and the longitudinal direction of the apparatus body 14 which intersects (in the embodiment, is orthogonal to) the vertical direction is a right-and-left direction X. In addition, a direction which intersects (in the embodiment, is orthogonal to) both the up-and-down direction Z and the right-and-left direction X is the forward-and-backward direction Y.

As shown in FIG. 1, a feeding portion 15 protruding upwards is arranged in the rear of the apparatus body 14. A roll sheet R formed by cylindrically rolling up a paper sheet S as a long medium is loaded within the feeding portion 15. An enclosure 16, which forms an exterior of the apparatus body 14, has an insertion slot 17 formed in front of the feeding portion 15, and the insertion slot 17 allows the paper sheet S fed from the feeding portion 15 to be imported into the enclosure 16.

A discharge slot 18 for discharging the paper sheet S out of the enclosure 16 is formed in the front side of the apparatus body 14. Moreover, a medium transport mechanism (not shown) for transporting the paper sheet S, fed from the feeding portion 15, through the insertion slot 17 toward the discharge slot 18 is provided within the enclosure 16. Then, a medium receptacle unit 19 for receiving the paper sheet S discharged from the discharge slot 18 is arranged in a position below the discharge slot 18 in the front side of the apparatus body 14.

In addition, on the top of the apparatus body 14, an operation panel 16P for performing setting and input operations is arranged at one end (in the rightmost position in FIG. 1) outside a transport path of the paper sheet S in the right-and-left direction X. At the bottom of the apparatus body 14, a liquid container retaining unit 20 is provided at one end (in the rightmost position in FIG. 1) outside the transport path of the paper sheet S in the right-and-left direction X and the liquid container retaining unit 20 retains liquid containers 21, each capable of storing an ink, an example of the liquid, within the container retaining element 22 in an insertable and removable manner.

Within the enclosure 16, a carriage 25 for carrying a liquid ejecting head 24 is provided so as to be able to reciprocate in the right-and-left direction X, i.e., a main scanning direction. Similarly within the enclosure 16, a liquid supplying mechanism (not shown) for supplying ink stored in the liquid containers 21 toward the liquid ejecting head 24 is provided. Then, the ink in the liquid containers 21 is consumed due to the fact that, in the printer 11, the ink supplied by the liquid supplying mechanism from the liquid containers 21, for example, is ejected as ink droplets from the liquid ejecting head 24 to the paper sheet S transported by the medium transport mechanism.

The liquid container retaining unit 20 has a configuration in which a plurality of (four in the embodiment) liquid containers 21, each corresponding to a type and a color of ink and having a substantially rectangular parallelepiped shape, are retained in the substantially box-shaped container retaining element 22 which opens at the front, and the plurality of liquid containers 21 may be retained so as to be juxtaposed to each other in the right-and-left direction. Moreover, the liquid container retaining unit 20 is covered by a lid member 23 pivotably attached to the apparatus body 14 so as not to be exposed at the front. When the liquid container 21 is inserted into and removed from the container retaining element 22, the lid member 23 is configured to pivot so as to expose the opening of the container retaining element 22 which faces forward (in +Y direction).

In the liquid container retaining unit 20 of the embodiment, the container retaining element 22 is configured to be able to retain the liquid containers 21 in the container retaining element 22, with at least one of four liquid containers 21 having a different width in the right-and-left direction X. This configuration will be described with reference to FIGS. 2 to 4.

Figure 2:
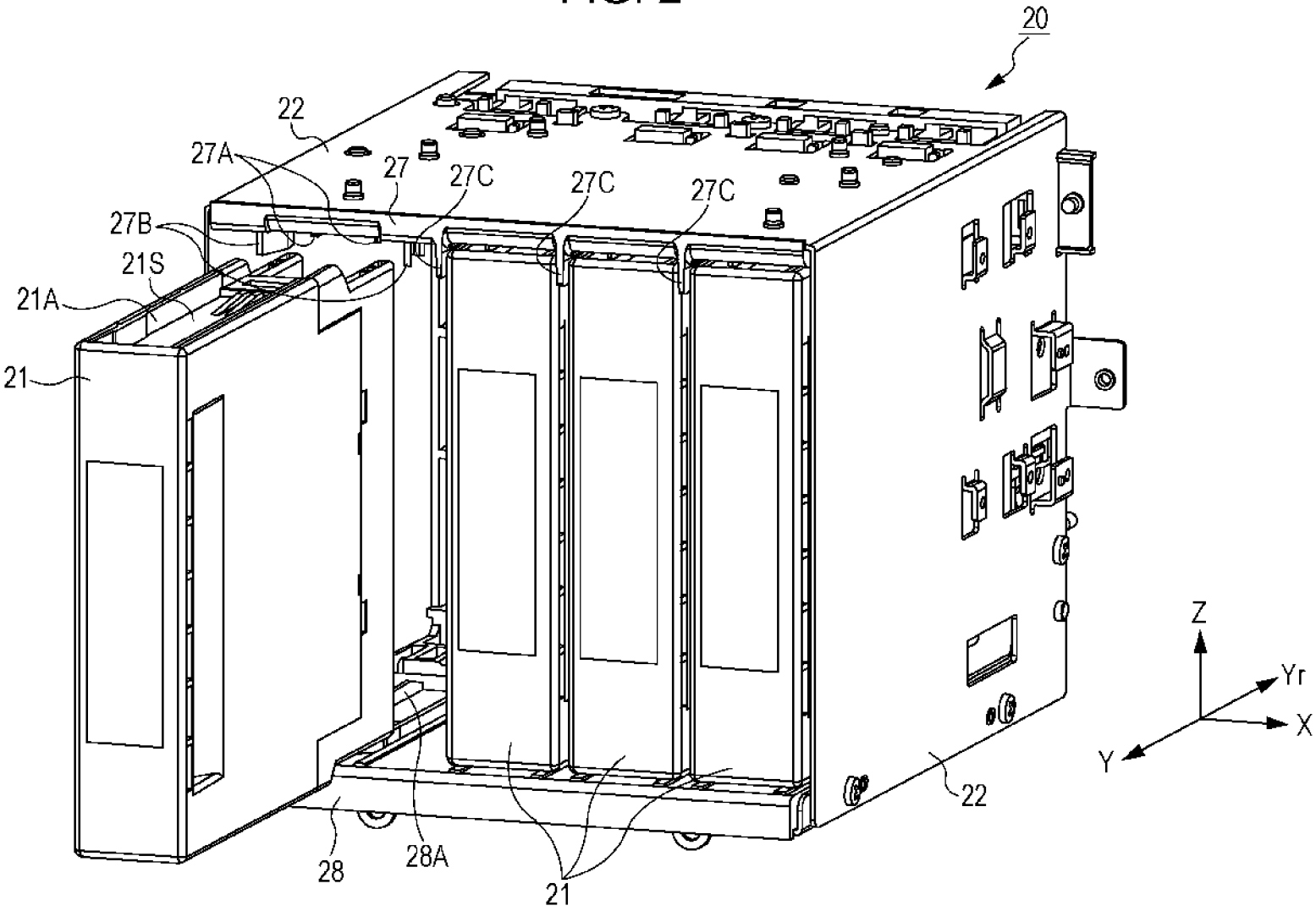
FIG. 2 is a perspective view showing one embodiment of a liquid container retaining unit included in the printer.
Figure 3:
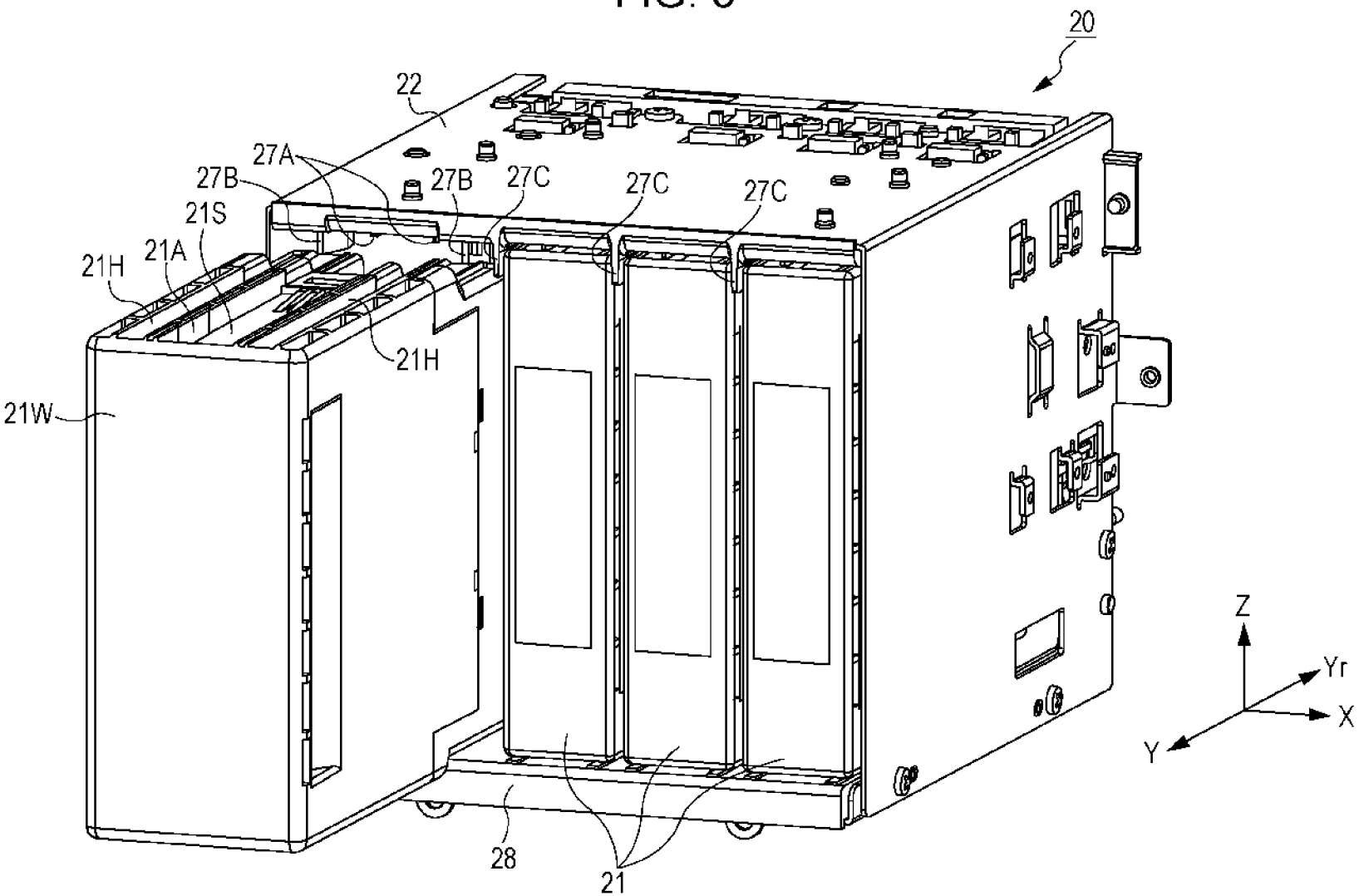
FIG. 3 is a perspective view showing the liquid container retaining unit having a container retaining element into which a wide liquid container is being inserted.
Figure 4:
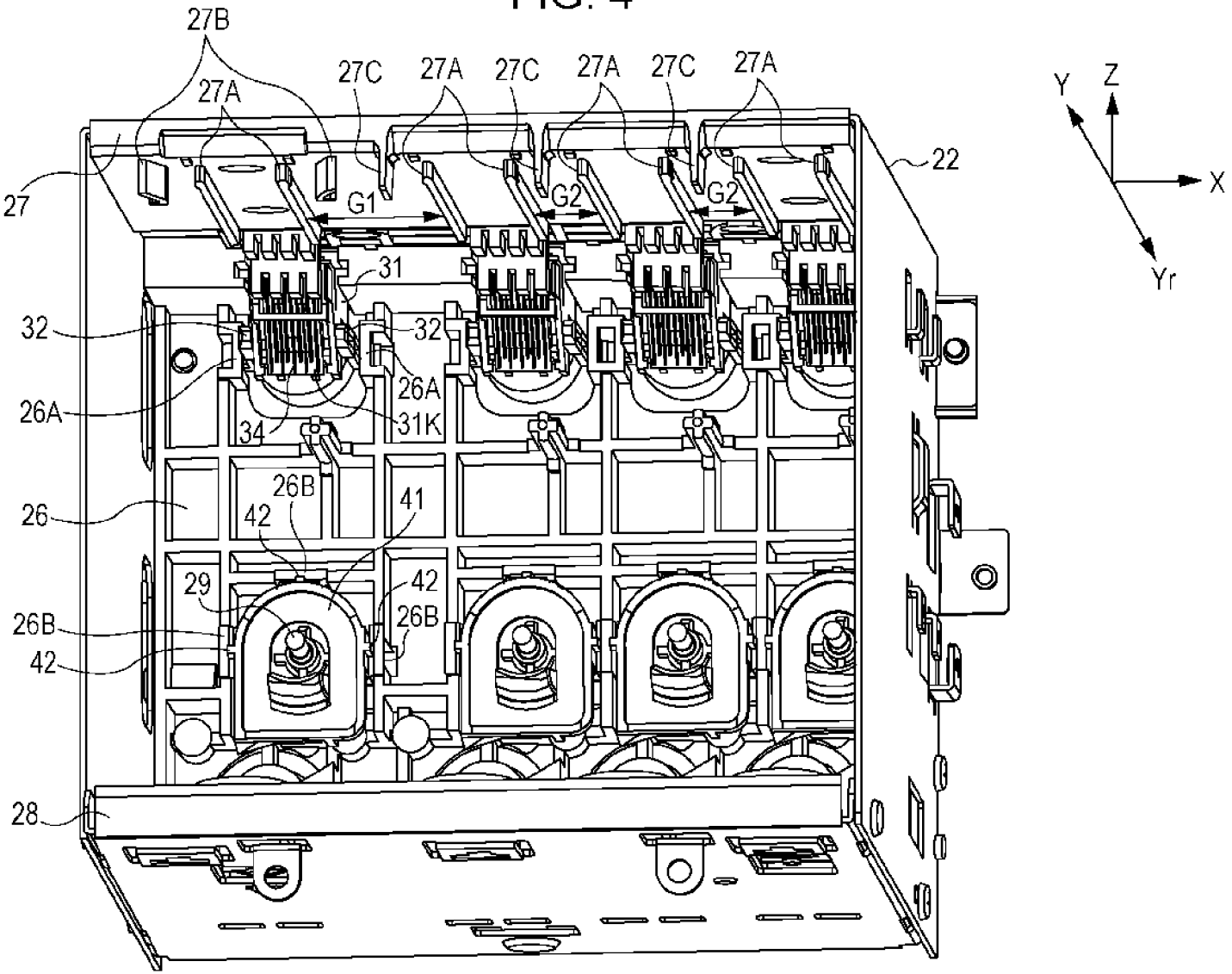
FIG. 4 is a perspective view showing the liquid container retaining unit having the container retaining element with the liquid containers removed.

As shown in FIGS. 2, 3, and 4, in the liquid container retaining unit 20 of the embodiment, the liquid container 21 of the four liquid containers 21 which is retained in the leftmost position in the container retaining element 22 may be a liquid container 21W having a width larger than that of the liquid containers 21, and this liquid container 21W may also be inserted into and removed from the liquid container retaining unit 20. That is, the substantially box-shaped container retaining element 22 has a ceiling member 27 attached to an inner ceiling surface. On the ceiling member 27, pairs of guide ribs 27A, i.e., ridges, protruding downward are, for example, spaced apart from each other by a predetermined distance in the right-and-left direction X and extend in the insertion direction Yr (the forward-and-backward direction Y) of the liquid containers 21, with each pair being arranged in a corresponding one of the insertion positions of the liquid containers 21 to be inserted, the insertion positions being juxtaposed to each other in the container retaining element 22 in the right-and-left direction X. The guide ribs 27A abut against inner surfaces 21A of walls, which are formed on each side of each of the liquid containers 21 in the right-and-left direction X, within a groove 21S extending along the top surface of the liquid container 21 in the forward-and-backward direction Y, whereby the liquid container 21 having been inserted into the container retaining element 22 is retained so that the top end of the liquid container 21 is located in the container retaining element 22 in the right-and-left direction X.

Then, the pair of the guide ribs 27A for the liquid container 21 retained in the leftmost position in the container retaining element 22 is arranged on the ceiling member 27 so that the spacing between the leftmost pair and the pair adjacent to it is larger than the spacing between one of the pairs of the guide ribs 27A for the other three liquid containers 21 and the pair adjacent to it other than the leftmost pair. That is, as shown in FIG. 4, in the embodiment, a gap G1 between the pair of the guide ribs 27A for the liquid container 21 retained in the leftmost position and the pair of the guide ribs 27A adjacent to the leftmost pair is set to be larger than a gap G2 between any two adjacent pairs among the other three pairs of the guide ribs 27A. Therefore, the gap G1 is set to be larger than the gap G2 so that, as shown in FIG. 3, the wide liquid container 21W is able to be inserted into the insertion position for the liquid container 21 retained in the leftmost position of the container retaining element 22. In other words, the gap G1 is set to have a spacing into which the wide liquid container 21W is able to be inserted.

In addition, a bottom member 28 is attached on the inner bottom surface of the substantially box-shaped container retaining element 22. Guide ribs 28A, i.e., the ridges extending in the forward-and-backward direction Y are arranged on the bottom member 28. Through the guide ribs 28A, i.e., the ridges, the liquid container 21 is retained so that a bottom end of each liquid container 21 to be inserted into the container retaining element 22 is positioned in the container retaining element 22 in the right-and-left direction X.

In addition, as shown in FIGS. 3 and 4, if the wide liquid container 21W is inserted in the leftmost position and the three liquid containers 21 inserted into the other positions in the container retaining element 22, each liquid container 21 and the wide liquid container 21W are positioned correctly. That is, at the end of the opening of the container retaining element 22, which is in the surface of the container retaining element 22 that faces forward in a direction opposite to the insertion direction Yr of the liquid container 21, positioning elements 27C protruding downward from the ceiling member 27 position the liquid containers 21 and the wide liquid container 21W in the right-and-left direction X.

Whereas, as shown in FIGS. 2 and 4, if one of the liquid containers 21 is inserted into the container retaining element 22 instead of the wide liquid container 21W, it is difficult to position the liquid container 21 in the right-and-left direction X by using the positioning elements 27C due to the narrower width of the liquid container 21 in the right-and-left direction X. To overcome this difficulty, in the embodiment, a pair of guide members 27B protrudes downward from the ceiling member 27 at the end portion toward the opening of the container retaining element 22 and helps guide the liquid container 21 into the container retaining element 22 so that the guide rib 27A is positioned within the groove 21S by being engaged with the top portion of the rear end of the liquid container 21 in the insertion direction Yr. The guide members 27B are arranged so that the spacing between them becomes increasingly narrow toward the deepest portion in the insertion direction Yr. Thus, as shown in FIG. 3, the wide liquid container 21W has a clearance groove 21H which is formed for preventing the container 21W from engaging with the guide member 27B when it is inserted into the container retaining element 22.

The liquid container retaining unit 20 of the embodiment includes for each of the liquid containers 21: a retaining mechanism for retaining the liquid container 21 having been inserted so as not to come out of the container retaining element 22; and an electrode connection structure for, via connected electrodes, transferring, for example, information such as data related to ink consumption to a memory arranged on the liquid container 21 having been inserted. The retaining mechanism and electrode connection structure will now be described with reference to FIGS. 4, 5A, 5B, 6A, and 6B.

Figure 5A:
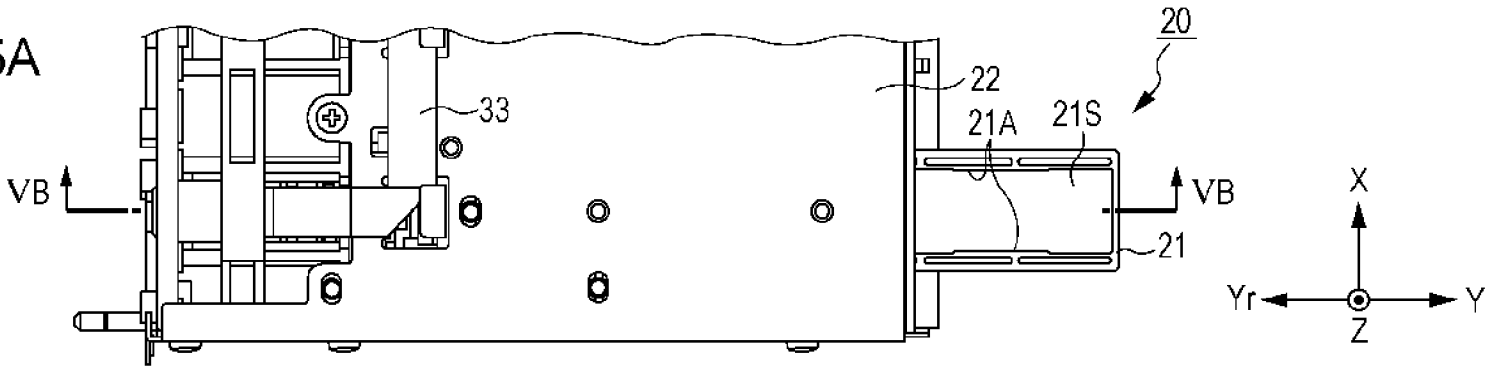
FIGS. 5A and 5B are a partial plan view and a sectional view taken along a line VB-VB in FIG. 5A, respectively, showing the liquid container retaining unit with the liquid container being partially inserted into the container retaining element.
Figure 5B:
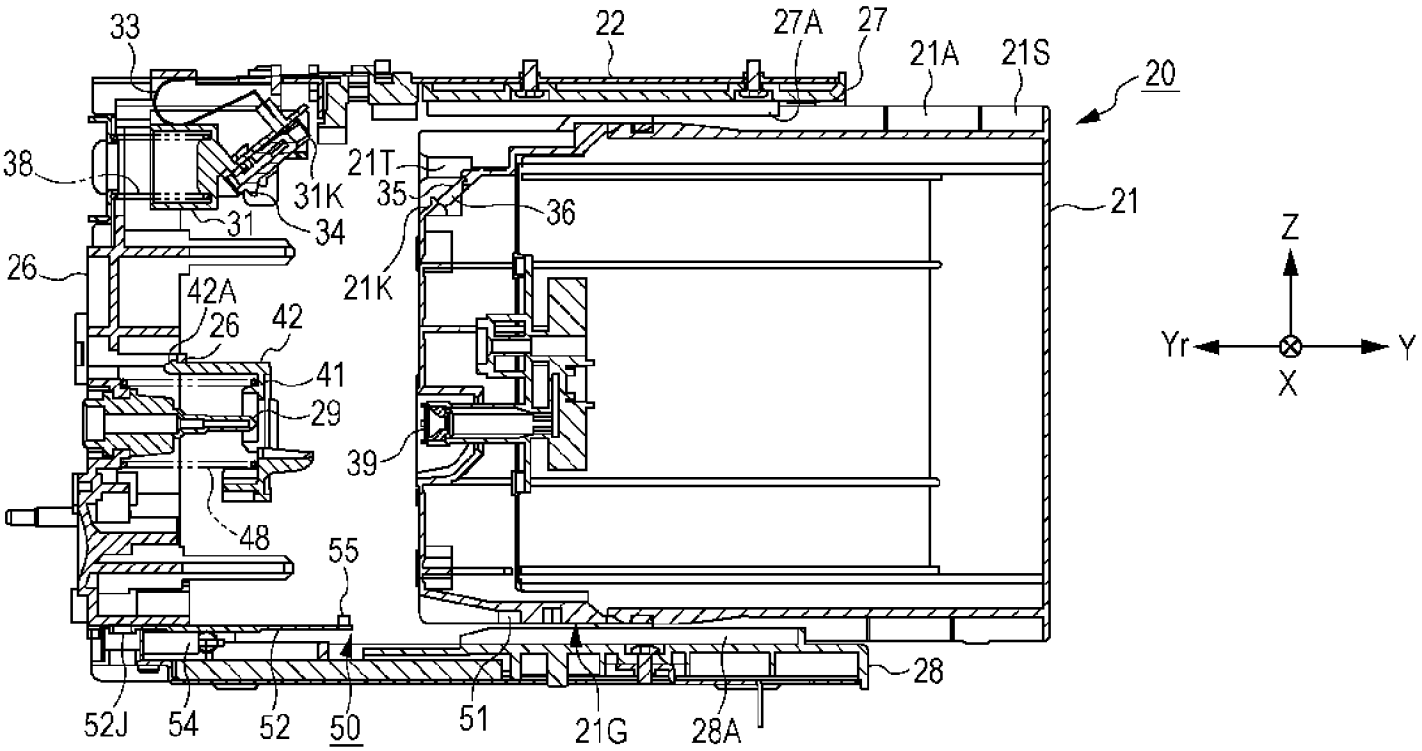

As shown in FIGS. 4, 5A and 5B, a wall member 26 extending perpendicularly to the insertion direction Yr is formed as a member constituting a rear wall of the container retaining element 22 at the inner deepest portion opposite the opening of the substantially box-shaped container retaining element 22, and the wall member 26 includes second electrodes 34. First electrodes 35 arranged on each of the liquid containers 21 abut against a corresponding one of the second electrodes 34 to be electrically connected so that data sent from a wiring substrate 33 such as a flexible substrate via the second electrodes 34 is transferred via the first electrodes 35 to a memory 36 included in the liquid container 21 and stored in the memory.

In the embodiment, as shown in FIG. 4, a movable member 31 slidable in the forward-and-backward direction Y parallel to the insertion direction Yr is arranged on the wall member 26 of the container retaining element 22. That is, the wall member 26 has pairs of slide guide members 26A with each pair being formed for a corresponding one of the liquid containers 21 and each member 26A having a guide recess (not shown) extending in the forward-and-backward direction Y and the movable member 31 has a pair of slide members 32 partly having a sliding portion (not shown) for sliding in a guide recess. Therefore, a sliding mechanism has a configuration in which the slide member 32 moves along the slide guide member 26A (the guide recess), and the movable member 31 slides in the forward-and-backward direction Y. Moreover, abutment of the rear end of the slide member 32 against the slide guide members 26A restricts the forward movement of the movable member 31.

In addition, in the embodiment, as shown in FIG. 5B, each of the liquid containers 21 has an inclined surface 21K which is inclined so that it intersects the insertion direction Yr, the inclined surface 21K being formed in the top end portion of a leading edge in the insertion direction Yr in which the liquid container 21 is inserted into the container retaining element 22 and having first electrodes 35 arranged thereon. Therefore, an opposing surface 31K, which is opposite the first electrodes 35 when the liquid container 21 is inserted into the container retaining element 22, is formed on the front side of the movable member 31 and the second electrodes 34 are arranged on the opposing surface 31K, the second electrodes 34 thus being arranged on the movable member 31. Then, the movable member 31 is arranged so that the second electrodes 34 are capable of abutting against the first electrodes 35 when the movable member 31 slides in the forward-and-backward direction Y in the wall member 26.

Moreover, in the embodiment, the first electrodes 35 are on a circuit board having a surface disposed on the inclined surface 21K of the liquid container 21 and more particularly, are metal pattern formed on the substrate surface. The circuit board includes an IC chip which serves as the memory 36. In addition, the second electrodes 34 are formed of metal plates cantilevered on the opposing surface 31K of the movable member 31 and the metal plates have connection sections that are capable of connecting with (abutment sections) the first electrodes 35 and that are capable of being slightly being displaced to ensure abutment against the first electrodes 35.

In addition, the circuit board arranged on the inclined surface 21K inclined with respect to the insertion direction Yr has a substrate surface area covering the inclined surface 21K which is larger than a projection area in the insertion direction Yr. Therefore, a plurality of metal patterns may be formed on the substrate surface of the circuit board and the formation of the plurality of metal patterns allows a plurality of the first electrodes 35 to be formed on the liquid container 21 moving in the insertion direction Yr.

The opposing surface 31K of the movable member 31 in the embodiment is urged toward the first electrodes 35 (forward herein) of the liquid container 21. That is, the wall member 26 includes a second urging member 38 for urging the movable member 31 in a direction opposite the insertion direction Yr, i.e., the direction in which the opposing surface 31K moves toward the first electrodes 35. Moreover, in the embodiment, a helical compression spring is used as the second urging member 38, and the movable member 31 is urged by the second urging member 38 while its forward movement is restricted.

In addition, the wall member 26 includes supply needles 29. Each of the supply needles 29 is inserted into a corresponding liquid supply port 39 arranged on a corresponding one of the liquid containers 21, whereby the ink stored in the liquid container 21 flows into the supply needle 29. The ink having flown into the supply needle 29 is supplied from the liquid container retaining unit 20 through a channel (not shown) formed in the wall member 26 to the liquid ejecting head 24 by the liquid supplying mechanism (also not shown). Moreover, the liquid container 21 includes, for example, a pouch-shaped ink package (not shown) therein and the ink stored in the ink package flows into the supply needle 29.

In addition, as shown in FIGS. 4 and 5B, the liquid container retaining unit 20 includes for each of the liquid containers 21: a movable body 41 which is disposed so as to surround the supply needle 29 and is movable in the forward-and-backward direction Y; and a first urging member 48 for urging the movable body 41 in a direction opposite the insertion direction Yr. In the embodiment, a helical compression spring is used as the first urging member 48 and disposed on the wall member 26 so that the supply needle 29 is positioned inside the helical coil.

Moreover, in the embodiment, the movable body 41 has three projections 42 formed so as to extend in the forward-and-backward direction Y and the movable body 41 slides in the forward-and-backward direction Y by the movement of the projections 42 along three groove members 26B arranged on the wall member 26. In addition, the movable body 41 has a configuration in which forward movement thereof is restricted by the abutment of the rear end 42A of each of the projections 42 against the wall member 26.

In the liquid container retaining unit 20 of the embodiment, when one of the liquid containers 21 is inserted into the container retaining element 22 and abuts against the movable body 41, an urging force is generated because the first urging member 48 is compressed in relation to the movement of the liquid container 21 in the insertion direction Yr. The generated urging force acts as a force pushing the liquid container 21 back via the movable body 41. For this reason, it is difficult to retain the liquid container 21 so that the liquid container 21 is pressed into the container retaining element 22 against the urging force of the first urging member 48. To overcome this difficulty, in the embodiment, a retaining mechanism 50 is provided for retaining the liquid container 21 in the container retaining element 22 so as not to come out of the container retaining element 22.

Figure 6A:
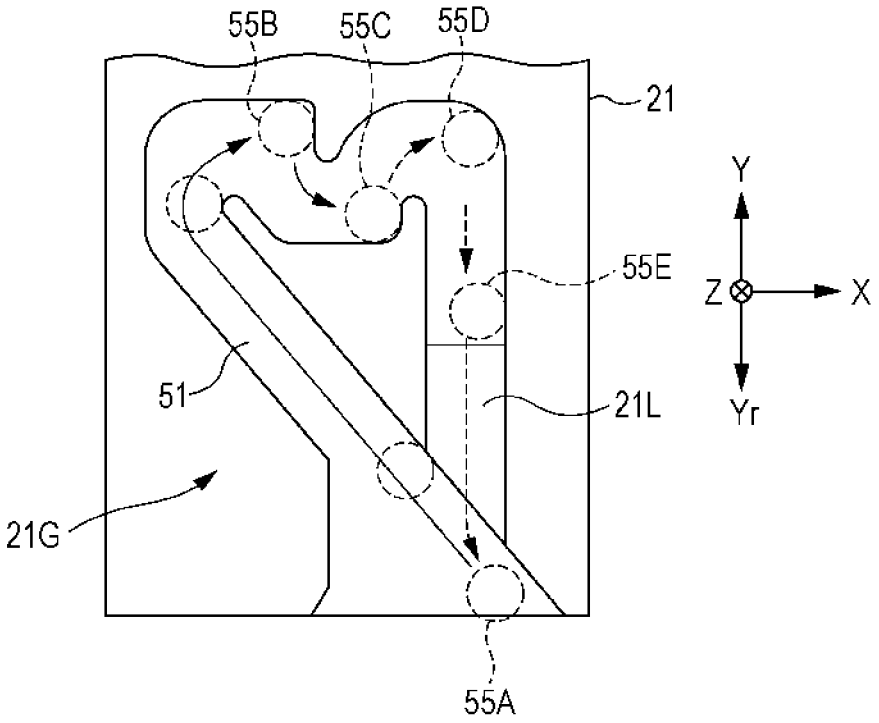
FIG. 6A is a partial bottom view of the liquid container having a cam constituting a container retaining mechanism and FIG. 6B is a diagram showing a configuration of a lever member which is disposed in the container retaining element and has a cam follower constituting the container retaining mechanism.
Figure 6B:
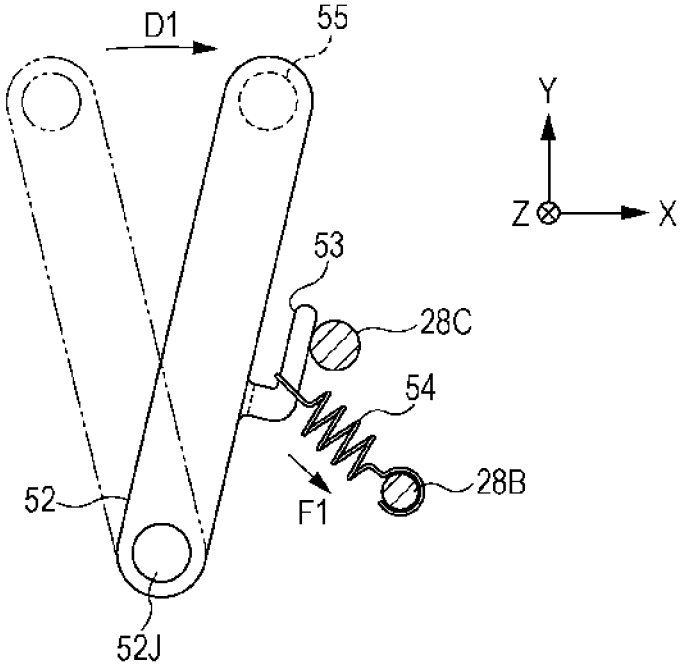

As shown in FIGS. 5B, 6A, and 6B, the retaining mechanism 50 includes: a cam-shaped portion 21G formed at the leading edge in the insertion direction Yr on the bottom surface of the liquid container 21; and a lever member 52 pivotably supported on the container retaining element 22 (the bottom member 28).

The lever member 52 pivots about a shaft 52J which is formed on a base end and whose axis extends in the up-and-down direction Z and a cylindrical pin 55 of the lever member 52 formed above from the tip end opposite the base end swings. Then, a tension F1 of a tension spring 54 laid between a claw 53 formed on the lever member 52 and a boss 28B arranged on the bottom member 28 urges the lever member 52 so as to swing consistently about the shaft 52J in one direction D1 (in a clockwise direction as viewed from the bottom herein). As a result, the cylindrical pin 55 formed on the lever member 52 is consistently urged to swing in one direction D1. Moreover, pivot of the lever member 52 in one direction D1 is restricted by a restricting pin 28C arranged on the bottom member 28.

In the retaining mechanism 50 configured in this manner, the cylindrical pin 55 as indicated by a circle in a dashed line in FIG. 6A, moves in relation to the insertion of the liquid container 21 into the container retaining element 22 in a cam groove 51 formed on the cam-shaped portion 21G along a path in a regular order. In other words, the cam-shaped portion 21G of the liquid container 21 serves as a cam and the cylindrical pin 55 of the lever member 52 serves as a cam follower.

That is, when the liquid container 21 is pressed into the container retaining element 22 against the urging force of the first urging member 48, the cylindrical pin 55 of the liquid container 21 moves as indicated by a solid arrow in FIG. 6A from an initial position indicated by symbol 55A to a position, indicated by symbol 55B, at which it is most pressed. Then, when pressing is released in this position, the liquid container 21 is slightly pushed back forward by the first urging member 48 and the cylindrical pin 55 swings in one direction D1 along the cam groove 51 and moves to a position shown by symbol 55C. This position is a restricting position where movement (swing) of the cylindrical pin 55 is restricted in the cam-shaped portion 21G and the cylindrical pin 55 positioned in the restricting position retains the liquid container 21 in the restricted state in in such a manner that movement in the removal direction by the urging force of the first urging member 48 is restricted. Therefore, the restricting position for the cylindrical pin 55 is a retaining position for the liquid container 21 where the liquid container 21 is retained in the restricted state in which movement in the removal direction is restricted.

After that, when the liquid container 21 in the restricted state is again pressed against the urging force of the first urging member 48 into the container retaining element 22 from the retaining position in the insertion direction Yr, the swing restriction of the cylindrical pin 55 in the cam groove 51 is released and the cylindrical pin 55 moves from the restriction position to a position indicated by symbol 55D in FIG. 6A. Then, pressing of the liquid container 21 is released during this movement, the liquid container 21 is pushed back by the first urging member 48 in the removal (forward) direction, and the cylindrical pin 55 moves to a position indicated by symbol 55E. In addition, in relation to the movement of the liquid container 21 in the removal direction by the urging force of the first urging member 48, the cylindrical pin 55 is pressed down so as to move on a slope 21L formed on the cam groove 51 from the position indicated by symbol 55E back to the initial position indicated by symbol 55A as indicated by dashed line arrows in FIG. 6A. In this manner, the retaining mechanism 50 has a configuration in which the cylindrical pin 55 repeats movement between the initial position and the restricted position in relation to pressing of the liquid container 21.

Operation of the liquid container retaining unit 20 of the embodiment will now be described with reference to FIGS. 7 to 9. Moreover, the liquid container 21 inserted into the leftmost position in the right-and-left direction X in the container retaining element 22 out of four liquid containers 21 inserted into the container retaining element 22 will be described herein. Of course, the liquid container retaining unit 20 functions similarly for both of the three liquid containers 21 inserted into other positions and the wide liquid container 21W inserted into the leftmost position in the container retaining element 22 in the right-and-left direction X.

Figure 7A:
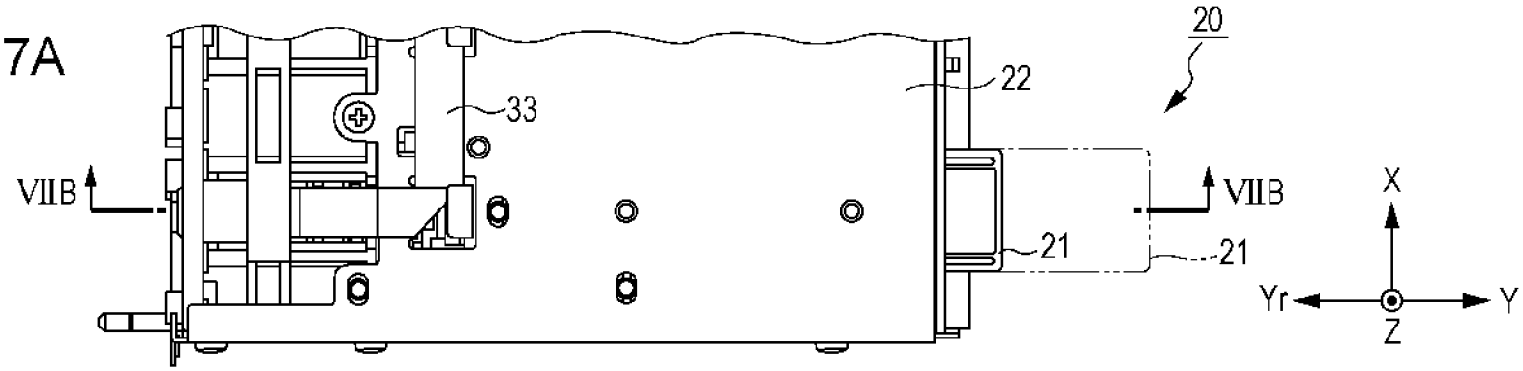
FIGS. 7A and 7B are a partial plan view and a sectional view taken along a line VIIB-VIIB in FIG. 7A, respectively, showing the liquid container retaining unit with the first urging member generating urging force against the liquid container having been inserted into the container retaining element.
Figure 7B:
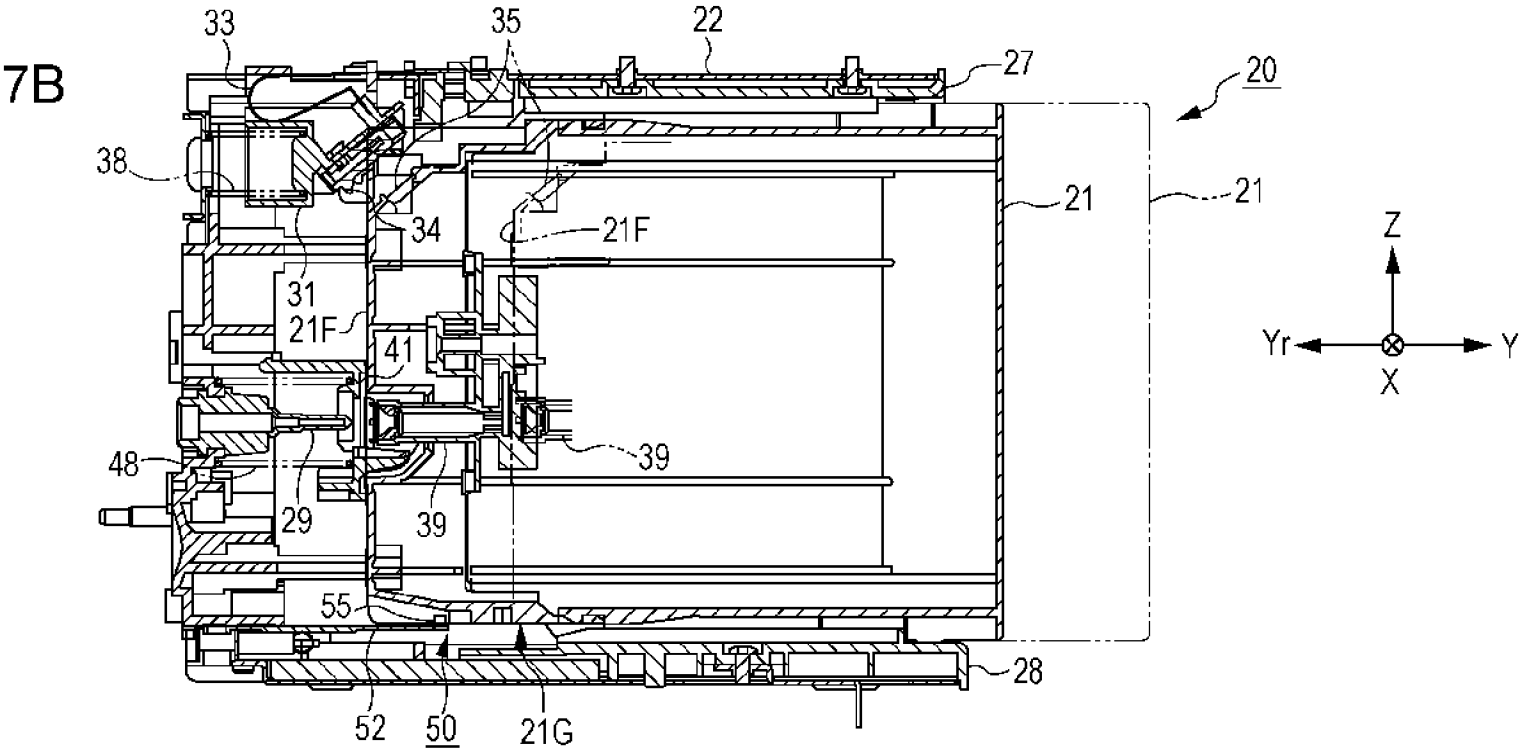

As shown in FIGS. 7A and 7B, for example, further pressing the partly inserted liquid container 21 shown in FIGS. 5A and 5B (indicated by a chain double-dashed line in FIGS. 7A and 7B) moves the liquid container 21 to an abutment position where a leading face 21F of the liquid container 21 in the insertion direction Yr abuts against the movable body 41. In the abutment position, the first electrodes 35 are positioned away from the second electrodes 34. In addition, the liquid supply port 39 is also positioned away from the supply needle 29. Then, when the liquid container 21 is pressed in the insertion direction Yr to move from the abutment position, the movable body 41 is pressed in the insertion direction Yr with the movement of the liquid container 21 and as a result the first urging member 48 is compressed and thus the urging force of the first urging member 48 against the liquid container 21 is generated.

Figure 8A:
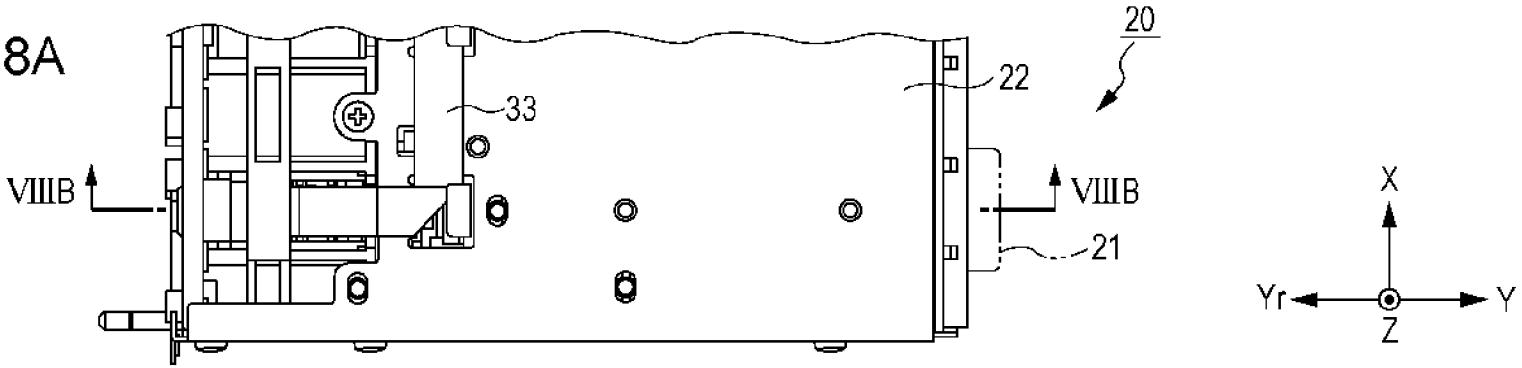
FIGS. 8A and 8B are a partial plan view and a sectional view taken along a line VIIIB-VIIIB in FIG. 8A, respectively, showing the liquid container retaining unit with the liquid container being reached at the deepest position in the container retaining element.
Figure 8B:
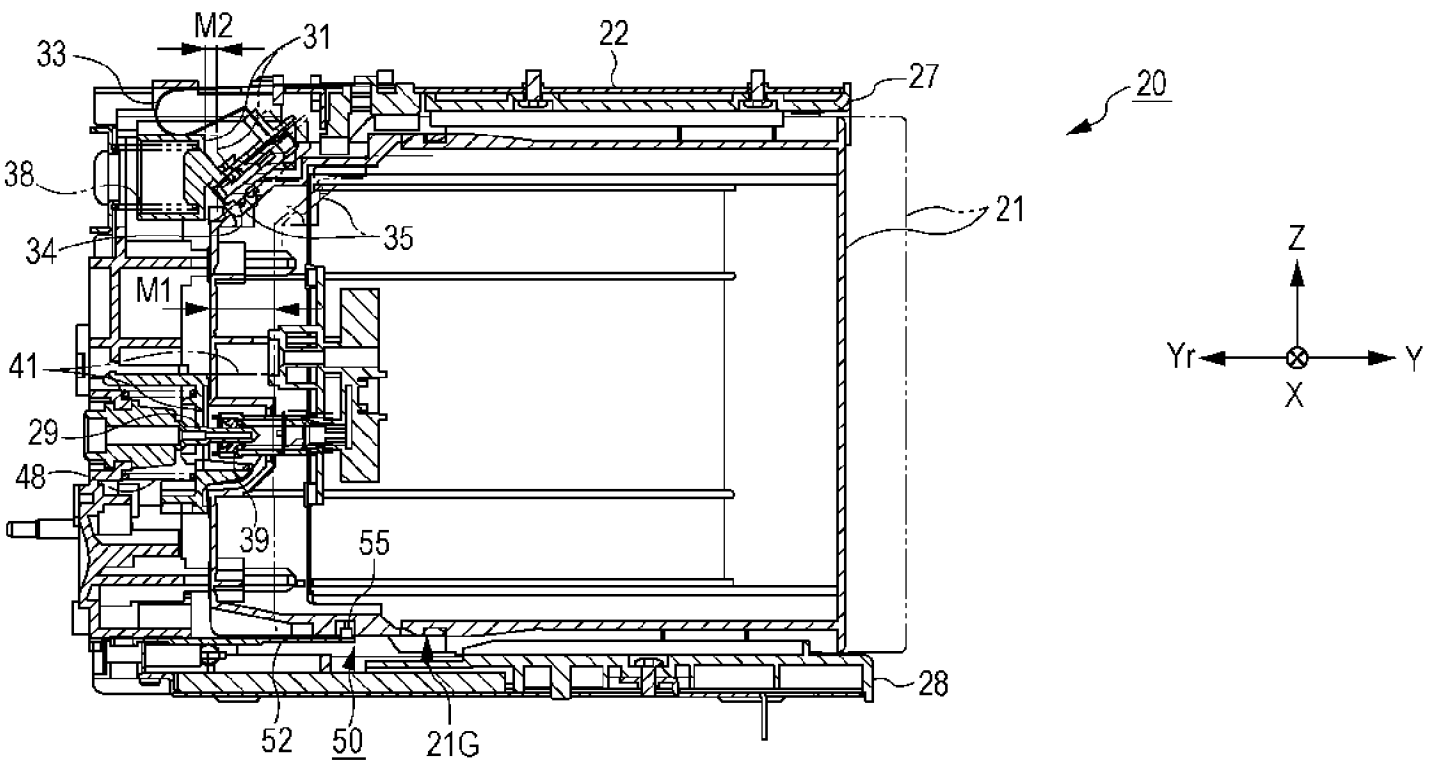

As shown in FIGS. 8A and 8B, pressing the liquid container 21 in the abutment position against the movable body 41 shown in FIGS. 7A and 7B (indicated by a chain double-dashed line in FIGS. 8A and 8B) against the urging force of the first urging member 48 in the insertion direction Yr results in the liquid container 21 being pressed deeply in the insertion direction Yr. That is, the liquid container 21 is pressed into the deepest position where the cylindrical pin 55 has moved to a position at which it is most pressed (see symbol 55B in FIG. 6A) in the retaining mechanism 50.

In the liquid container retaining unit 20 of the embodiment, there is a connection position where the first electrodes 35 abut against the second electrodes 34 so as to be electrically connected to it halfway from the abutment position for the liquid container 21 to the deepest position. Moreover, in the connection position, the second electrodes 34 that are to abut against the first electrodes 35 arranged on the inclined surface 21K are pressed perpendicularly to the first electrodes and, for example, moves along the inclined surface relative to the first electrodes arranged on the inclined surface with respect to the insertion direction Yr by slightly moving the second electrodes 34.

In addition, in the embodiment, the supply needle 29 is inserted into the liquid supply port 39 before the liquid container 21 moves to the connection position and a member 21T of the liquid container 21 (see FIG. 5) abuts against the movable member 31 (for example, the slide member 32) with the first electrodes 35 abutting against the second electrodes 34. After that, the liquid container 21 consistently moves the movable member 31 having the second electrodes 34 thereon to the deepest position in a direction parallel to the insertion direction Yr of the liquid container 21 by the sliding mechanism, with the first electrodes 35 abutting against the second electrodes 34.

In addition, the movable member 31 moves in the insertion direction Yr in relation to the movement of the liquid container 21 from the connection position to the deepest position in the insertion direction Yr, whereby the urging force of the second urging member 38 is generated to urge the liquid container 21 via the movable member 31. That is, the first urging member 48 is initially compressed to generate the urging force of the first urging member 48 against the liquid container 21 when the liquid container 21 moves in the insertion direction Yr, before the second urging member 38 is compressed to generate the urging force of the second urging member 38 against the movable member 31.

As a result, the second electrodes 34 arranged on the movable member 31 are urged by the urging force of the second urging member 38 in the direction opposite to the insertion direction Yr, whereby the movable member 31 moves from the connection position to the deepest position with abutment of the first electrodes 35 and the second electrodes 34 being maintained.

Moreover, as shown in FIG. 8B, in the embodiment, a movement distance M1 by which the movable body 41 moves against the urging force of the first urging member 48 is set to be longer than a movement distance M2 by which the movable member 31 moves against the urging force of the second urging member 38.

Figure 9A:
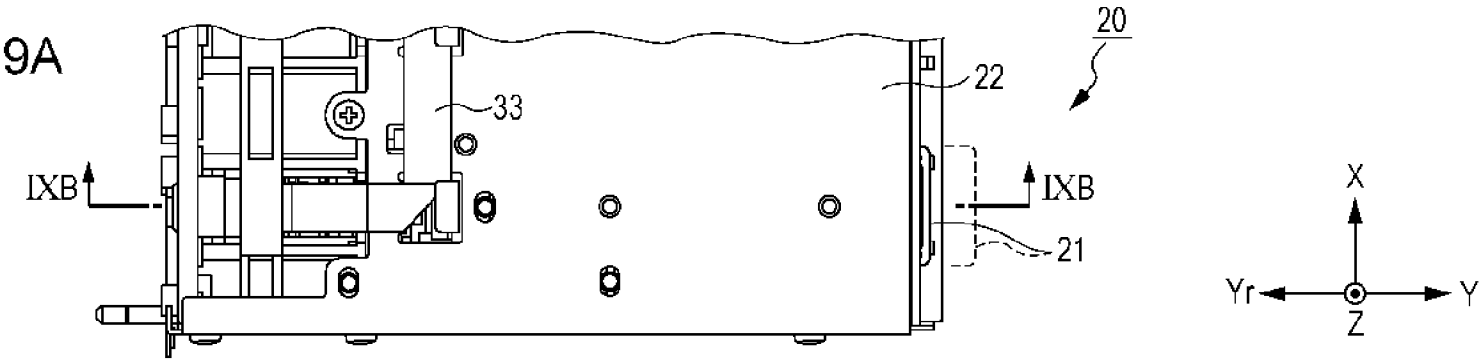
FIGS. 9A and 9B are a partial plan view and a sectional view taken along a line IXB-IXB in FIG. 9A, respectively, showing the liquid container retaining unit which is retained in a restricted state in which the liquid container having been inserted into the container retaining element is restricted so as not to move in the removal direction by the urging force of the first urging member.
Figure 9B:
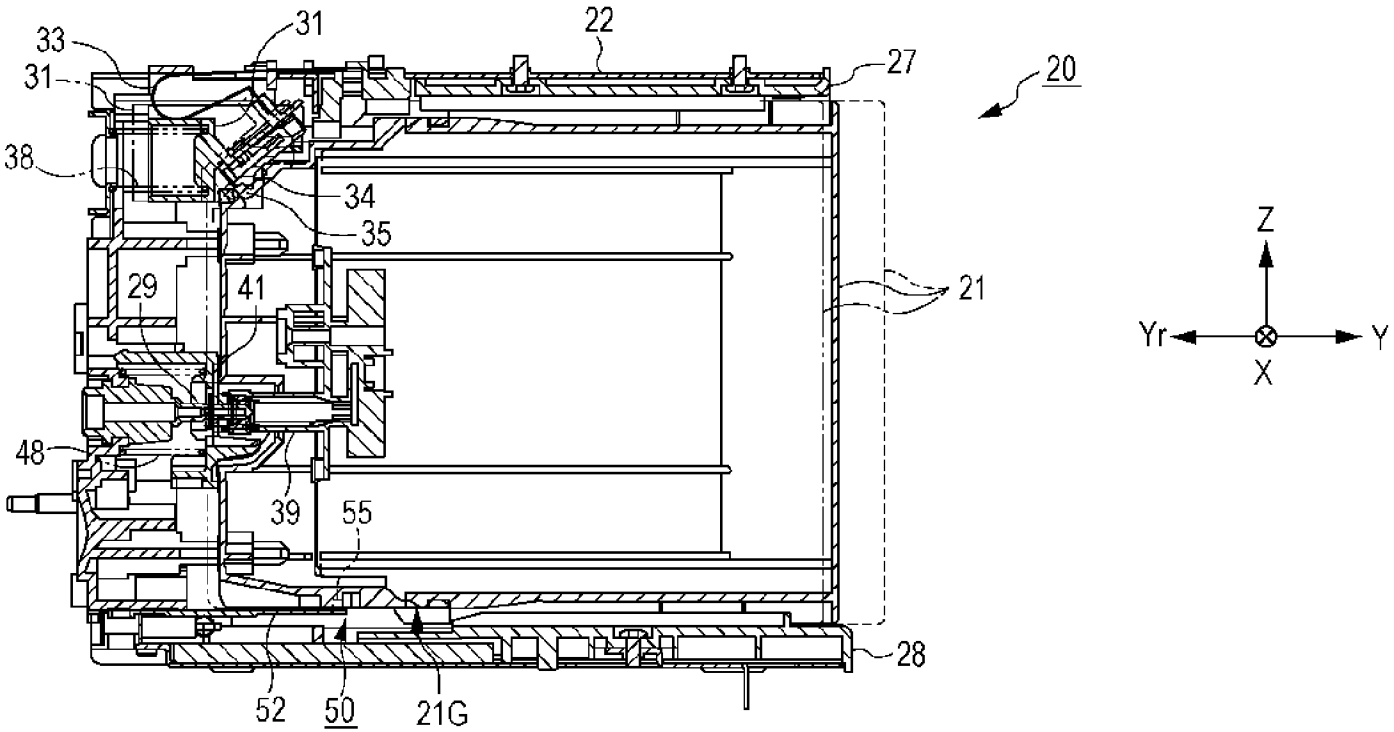

As shown in FIGS. 9A and 9B, the force pressing the liquid container 21 backward (indicated by a chain double-dashed line in FIGS. 9A and 9B) having moved to the deepest position shown in FIGS. 8A and 8B is released and as a result the liquid container 21 is pushed forward by the urging force of the first urging member 48. Thereby, by the cylindrical pin 55 having moved to the restriction position (see symbol 55C in FIG. 6A) in the retaining mechanism 50, the liquid container 21 is positioned in the retaining position so as to be in the restricted state where the liquid container 21 is restricted from moving so as not come out of the container retaining element 22.

During the movement of the liquid container 21 from the deepest position to the retaining position, the movable member 31 is urged toward the first electrodes 35 by the urging force generated by the second urging member 38, thereby maintaining the abutment of the first electrodes 35 and the second electrodes 34. In addition, when the liquid container 21 is in the retaining position, the supply needle 29 is maintained so as to be inserted in the liquid supply port 39.

Then, the liquid container 21 in the retaining position is pressed again backward (in the insertion direction Yr), thereby moving the liquid container 21 to the abutment position shown in FIGS. 7A and 7B (indicated by a dashed line in FIGS. 9A and 9B) against the movable body 41. That is, the liquid container 21 is pressed against the urging force of the first urging member 48, whereby the liquid container 21 is released from the restricted state and pushed back to the abutment position by the urging force by the first urging member 48 via the movable body 41.

Moreover, in the embodiment, when the liquid container 21 is pushed back from the retaining position to the abutment position, the first electrodes 35 and the second electrodes 34 are released from the abutment state before the supply needle 29 is removed from the liquid supply port 39. That is, the liquid is capable of being supplied from the liquid container 21 to the supply needle 29 while the abutment of the first electrodes 35 and the second electrodes 34 is maintained. Therefore, inversely, when the liquid container 21 is pressed from the abutment position to the retaining position (the deepest position), the supply needle 29 is inserted into the liquid supply port 39 before the first electrodes 35 and the second electrodes 34 abut against each other so as to be electrically connected.

According to the above described embodiment, following effects may be obtained.

(1) For example, even if a reaction force against the urging force of the first urging member 48 generated with the insertion of the liquid container 21 deforms the container retaining element 22, the urging force by the second urging member 38 causes the second electrodes 34 on the container retaining element 22 to abut against the first electrodes 35 on the liquid container 21 without being affected by the deformation of the container retaining element 22. Therefore, this can increase the reliability of the electrical connection between the first electrodes 35 and the second electrodes 34.

(2) When the second electrodes 34 are arranged on the opposing surface 31K of the movable member 31 movably arranged in the container retaining element 22 and the liquid container 21 is inserted into the container retaining element 22, the second urging member 38 urges the movable member 31 in a direction so that the opposing surface 31K moves toward the first electrodes 35. Therefore, regardless of the presence or absence of deformation of the container retaining element 22 by a reaction force against the urging force of the first urging member 48, the second electrodes 34 arranged on the opposing surface of the movable member 31 abut against the first electrodes 35 with the second electrodes 34 being urged by the second urging member 38, which can increase the reliability of the electrical connection between the first electrodes 35 and the second electrodes 34.

(3) The sliding mechanism slides the movable member 31 in a direction parallel to the insertion direction Yr of the liquid container 21, thereby obtaining consistent positional accuracy between the first electrodes 35 and the second electrodes 34, which can increase the reliability of the electrical connection between the first electrodes 35 and the second electrodes 34.

(4) The second electrodes 34 on the container retaining element 22 to abut against the first electrodes 35 arranged on the inclined surface 21K of the liquid container 21 to be inserted may be moved relative to the first electrodes 35 along the inclined surface 21K while being pressed perpendicularly to the inclined surface 21K. Therefore, the relative movement while being pressed can increase the reliability of the electrical connection between the first electrodes 35 and the second electrodes 34. In addition, the second urging member 38 urges the movable member 31 by the sliding mechanism in the removal direction of the liquid container 21, whereby not only the first urging member 48 but also the second urging member 38 causes the liquid container 21 to move in the removal direction by the urging force. Therefore, the liquid container 21 having been released from the restricted state may be consistently come out of the container retaining element 22.

(5) When the liquid container 21 is inserted into the container retaining element 22, after the liquid container 21 is urged by the urging force of the first urging member 48 in the removal direction, the urging force of the second urging member 38 urges the second electrodes 34 so as to cause the second electrodes 34 to abut against the first electrodes 35. Therefore, for example, because a user presses the liquid container 21 into the container retaining element 22 against the urging force so that the first electrodes 35 and the second electrodes 34 are electrically connected to each other, the first electrodes 35 and the second electrodes 34 may be inhibited from accidentally electrically connecting to each other when the liquid container 21 is inserted into the container retaining element 22.

(6) Within the movement range of the liquid container 21 in the removal direction where the first urging member 48 urges the liquid container 21 when the liquid container 21 is removed, the second urging member 38 may be in a state in which it does not urge the second electrodes 34 against the first electrodes 35. Therefore, for example, while the liquid container 21 moves due to the urging force of the first urging member 48 in the removal direction, the first electrodes 35 and the second electrodes 34 may be electrically disconnected.

(7) For example, even if a reaction force against the urging force of the first urging member 48 generated in relation to the insertion of the liquid container 21 deforms the container retaining element 22, a printer 11 may be obtained which increases the reliability of the electrical connection between the first electrodes 35 and the second electrodes 34 without being affected by the deformation of the container retaining element 22.

Moreover, the above embodiment may be modified to other embodiments below.

In the above embodiment, the liquid container 21 may not necessarily include the first electrodes on the inclined surface 21K which is inclined so that it intersects the insertion direction Yr in which the liquid container is inserted into the container retaining element 22. For example, the first electrodes 35 may be arranged on a side whose perpendicular line runs in the insertion direction Yr (i.e., in a direction perpendicular to the insertion direction Yr).

Figure 10:
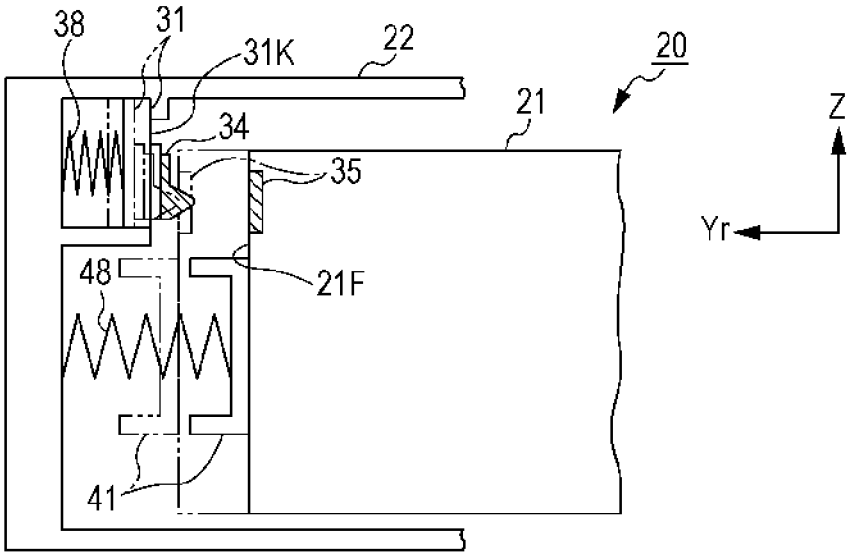
FIG. 10 is a block diagram showing another embodiment of the liquid container retaining unit having first electrodes arranged on a surface other than an inclined surface of a liquid container.

That is, as shown by an example in FIG. 10, the liquid container retaining unit 20 may have a configuration in which the first electrodes 35 are arranged on an upper portion of the leading face 21F whose perpendicular line runs in the insertion direction Yr of the liquid container 21 and in which the second electrodes 34 are arranged on the movable member 31 having the opposing surface 31K which is facing the first electrodes 35 and is parallel to the leading face 21F of the liquid container 21. In this case, the second electrodes 34 are inhibited from moving relative to the first electrodes 35; however, the reliability of the electrical connection between the first electrodes 35 and the second electrodes 34 can be obtained by the urging force generated by the compression of the second urging member 38 against the second electrodes 34. Moreover, FIG. 10 diagrammatically shows the liquid container retaining unit 20.

Alternatively, in the above embodiment, the movable member 31 may not necessarily be configured to move in a direction parallel to the insertion direction Yr. This variation will be described with reference to FIGS. 11A and 11B. Moreover, FIGS. 11A and 11B diagrammatically show the liquid container retaining unit 20.

Figure 11A:
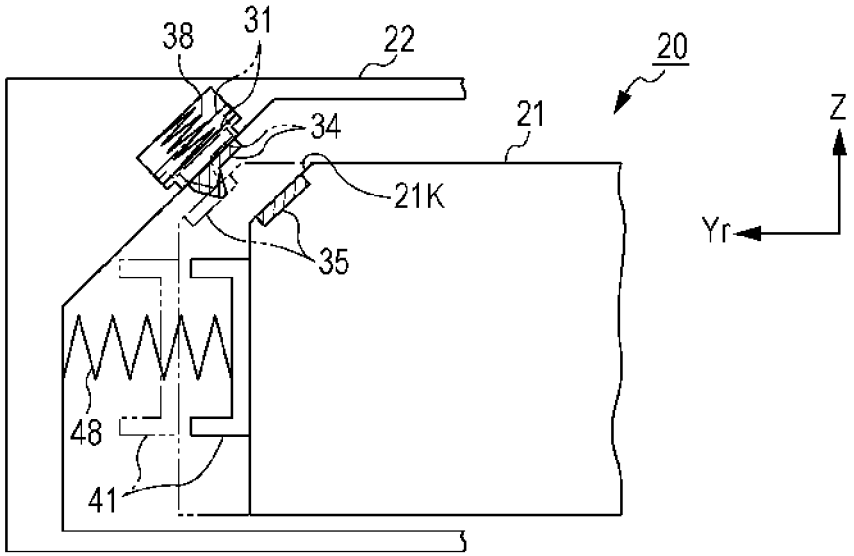
FIG. 11A is a block diagram of another embodiment of a liquid container retaining unit in which a movable member having second electrodes thereon slides perpendicularly to an inclined surface of a liquid container and FIG. 11B is a block diagram of another embodiment of a liquid container retaining unit in which a movable member having second electrodes thereon slides perpendicularly to an insertion direction of the liquid container.

For example, as shown in FIG. 11A, the movable member 31 may slide perpendicularly to the inclined surface 21K of the liquid container 21. According to this configuration, an urging force generated by the second urging member 38 against the second electrodes 34 causes the second electrodes 34 to press against the first electrodes 35 in a direction forming a small angle with each other. Therefore, even if a plurality of second electrodes 34 are disposed, the second urging member 38 may almost always cause the second electrodes 34 to abut against the first electrodes 35.

Figure 11B:
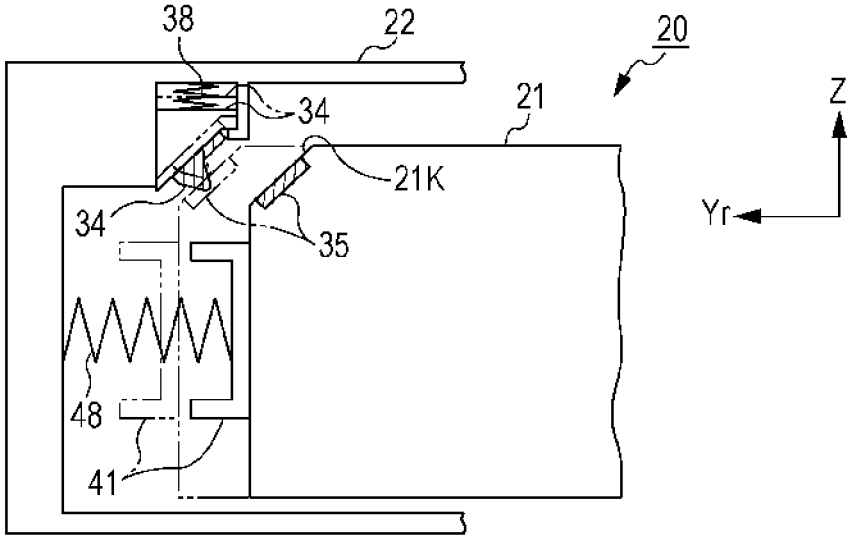

Alternatively, as shown in FIG. 11B, the movable member 31 may slide perpendicularly to the insertion direction Yr of the liquid container 21. According to this configuration, for example, even if possible insertion distance of the container retaining element 22 in the printer 11 in the insertion direction Yr is small, the second urging member 38 may generate an urging force to cause the second electrodes 34 to abut against the first electrodes 35.

In the above embodiment, the container retaining element 22 may not necessarily include the movable member 31 therein. For example, the second urging member 38 may be configured to be also used as the movable member 31. This variation will be described with reference to FIGS. 12A and 12B. Moreover, FIGS. 12A and 12B diagrammatically show the liquid container retaining unit 20.

Figure 12A:
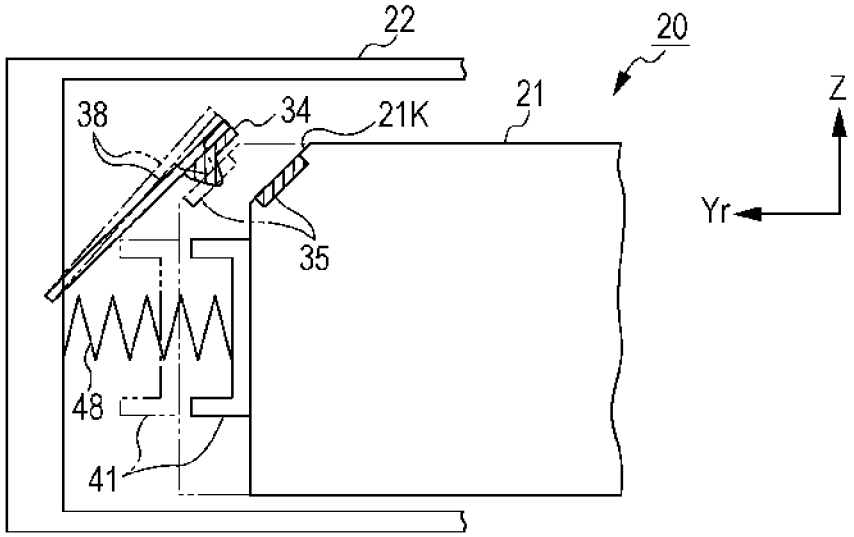
FIG. 12A is a block diagram of first electrodes arranged on an inclined surface of a liquid container and FIG. 12B is a block diagram of first electrodes arranged on a surface other than the inclined surface of the liquid container, both of the figures showing another embodiment of a liquid container retaining unit in which a second urging member is also used as a movable member.

As shown in FIG. 12A, for example, the liquid container retaining unit 20 may have a configuration in which the second urging member 38 is formed of a plate spring having a base end which is secured to the container retaining element 22 and a tip end which constitutes the opposing surface facing the inclined surface 21K, and the second electrodes 34 are arranged on the opposing surface. According to this configuration, the second electrodes 34 abut against the first electrodes 35 and displace in the insertion direction Yr with the insertion of the liquid container 21. When the second electrodes 34 displace in the insertion direction Yr, the second urging member 38 moves in the insertion direction Yr, whereby the second urging member 38 generates the urging force for urging the second electrodes and functions as the movable member.

Figure 12B:
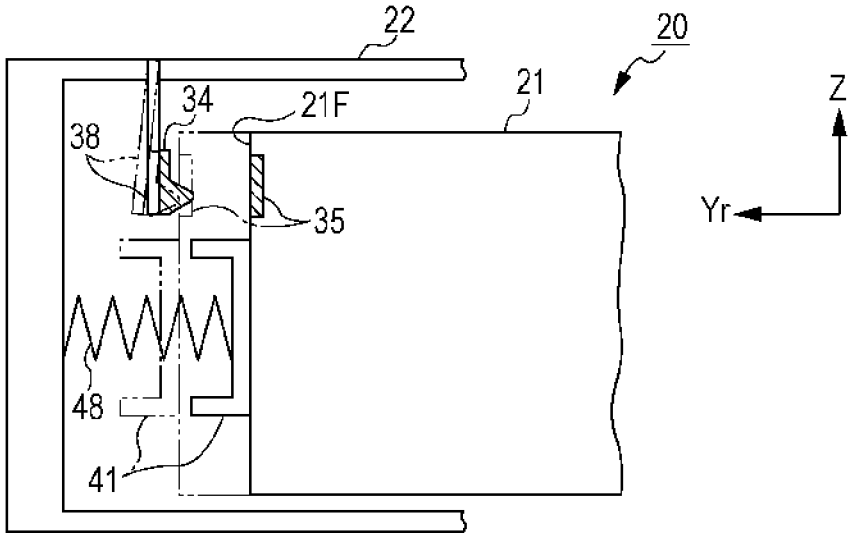

In addition, as shown in FIG. 12B, the liquid container retaining unit 20 may have a configuration in which if the first electrodes 35 are arranged on the leading face 21F of the liquid container 21 which extends orthogonally to the insertion direction Yr, for example, the second urging member 38 is formed of a plate spring having a base end which is secured to an inner ceiling surface of the container retaining element 22 and a tip end which constitutes the opposing surface facing the leading face 21F and the second electrodes 34 are arranged on the opposing surface. According to this configuration, the second electrodes 34 abut against the first electrodes 35 and displace in the insertion direction Yr with the insertion of the liquid container 21. When the second electrodes 34 displace in the insertion direction Yr, the second urging member 38 moves in the insertion direction Yr, whereby the second urging member 38 generates the urging force for urging the second electrodes and functions as the movable member.

In the above embodiment, the movement distance M1 of the liquid container 21 in the removal direction over which the generated urging force of the first urging member 48 urges the liquid container 21 may be smaller than or equal to the movement distance M2 of the liquid container in the removal direction over which the generated urging force of second urging member 38 urges the second electrodes 34. This variation may be employed, for example, when it has a configuration in which when the liquid container 21 has been pushed forward by the urging force of the first urging member 48 and the supply needle 29 has been inserted into the liquid supply port 39, the first electrodes 35 and the second electrodes 34 are disconnected before the liquid container 21 is removed further forward and the supply needle 29 is removed from the liquid supply port 39. Alternatively, it may be employed when it is acceptable that the supply needle 29 is inserted into the liquid supply port 39 after the first electrodes 35 and the second electrodes 34 are connected to each other.

In the above embodiment, the second urging member 38 may have a configuration in which, the urging force for urging the second electrodes 34 is generated before the urging force of the first urging member 48 is generated in relation to the insertion of the liquid container 21 into the container retaining element 22 or a configuration in which these urging forces are simultaneously generated. This variation may be employed, for example, when it is acceptable that before the urging force of the first urging member 48 urges the liquid container 21, the first electrodes 35 and the second electrodes 34 are electrically connected to each other.

In the above embodiment, the first urging member 48 may not necessarily be disposed around the supply needle 29, and may disposed, for example, above or below the supply needle 29.

In the above embodiment, the first urging member 48 or the second urging member 38 may be, for example, a member other than a coil spring, such as a U-shaped plate spring.

In the above embodiment, the number of the liquid containers 21 retained in the container retaining element 22 is not necessarily limited to four. In addition, the position in which the wide liquid container 21W is retained is not necessarily the leftmost position.

In the above embodiment, the printer 11 may be a liquid ejecting apparatus for ejecting or discharging a liquid other than an ink. Moreover, a liquid to be discharged in a very small amount of liquid droplets from the liquid ejecting apparatus may also include a liquid that leaves a granular shape, a teardrop shape, a threadlike shape trail. In addition, the term "liquid" herein should be such a material that is capable of being ejected from the liquid ejecting apparatus. For example, the "liquid" may be any material in the liquid phase and may include liquid-state materials of high viscosity or low viscosity, sols, gel water, various inorganic solvents and organic solvents, solutions, liquid resins and liquid metals (metal melts). In addition, the "liquid" may include not only a liquid as one state of materials, but solvents in which particles of a functional material including solid material such as pigment and metallic particles are dissolved, dispersed, or mixed. A typical example of the liquids may be an ink, a liquid crystal, or the like described in the above embodiments. The term "ink" herein may include a variety of compositions in the form of a liquid, such as a common water-soluble ink and an oil-soluble ink as well as a gel ink, a hot-melt ink, and the like. One specific example of the liquid ejecting apparatus includes, for example, a liquid ejecting apparatus for ejecting a liquid containing an electrode material, a colorant, or the like in a dispersed or dissolved form, which is used for manufacturing a liquid crystal display device, an EL (electroluminescent) display device, a surface emission display device, a color filter. Alternatively, it may be a liquid ejecting apparatus for ejecting bio-organic substance used for bio-chip production, a liquid ejecting apparatus for ejecting a liquid as a test sample, used as a precision pipette, a printing apparatus, a micro-dispenser or the like. It may also be a liquid ejecting apparatus for ejecting a lubricant at pinpoints onto a precision machine such as a timepiece, a camera, or the like, a liquid ejecting apparatus for ejecting a translucent resin liquid such as an ultraviolet-curable resin onto a substrate, for forming a hemispherical micro-lens (an optical lens) or the like used in an optical communication element or the like. Also, it may be a liquid ejecting apparatus for ejecting an etching solution, such as an acid or an alkali in order to etch a substrate or the like.

The entire disclosure of Japanese Patent Application No. 2012-281572, filed Dec. 25, 2012 is incorporated by reference herein.

What is claimed is:

1. A liquid container retaining unit comprising:

a container retaining element for retaining a liquid container having first electrodes in an insertable and removable manner, the container retaining element having second electrodes that are capable of being abutted against the first electrodes;

a first urging member for generating, in relation to the insertion of the liquid container into the container retaining element, an urging force to urge the liquid container in a removal direction opposite to an insertion direction in which the liquid container is inserted into the container retaining element;

a container retaining mechanism for retaining the liquid container inserted into the container retaining element in a restricted state in which movement of the liquid container in the removal direction by the urging force of the first urging member is restricted, and for releasing the liquid container from the restricted state by moving the liquid container retained in the restricted state in the insertion direction so that the urging force of the first urging member is capable of moving the liquid container in the removal direction, the container retaining mechanism selectively engaging with the liquid container and following a first path to the restricted state and a second path to a released state, the first path being different from the second path;

a second urging member for generating, when the liquid container is retained within the container retaining element in the restricted state, an urging force to urge the second electrodes so as to cause the first electrodes on the liquid container and the second electrodes on the container retaining element to abut against each other, and wherein the first and second urging members are separate members, wherein the liquid container has an inclined surface which is inclined so that it intersects the insertion direction in which the liquid container is inserted into the container retaining element, wherein the first electrodes are arranged on the inclined surface, wherein the second urging member generates an urging force against the second electrodes after the urging force of the first urging member has been generated with the insertion of the liquid container into the container retaining element, and wherein the movement distance of the liquid container in the removal direction over which the urging force of the first urging member urges the liquid container is larger than the movement distance of the liquid container in the removal direction over which the urging force of the second urging member urges the second electrodes.

2. The liquid container retaining unit according to claim 1:

further comprising a movable member which is movably arranged in the container retaining element and has an opposing surface facing the first electrodes arranged on the liquid container when the liquid container has been inserted;

wherein the second electrodes are arranged on the opposing surface of the movable member; and wherein the second urging member urges the movable member in a direction such that the opposing surface moves toward the first electrodes of the liquid container having been inserted into the container retaining element.

3. The liquid container retaining unit according to claim 2, wherein the container retaining element includes a sliding mechanism for sliding the movable member in a direction parallel to the insertion direction of the liquid container.

4. A liquid ejecting apparatus comprising:

a liquid container retaining unit according to claim 3; and a liquid ejecting head being capable of ejecting a liquid supplied from the liquid container retained in the liquid container retaining unit.

5. A liquid ejecting apparatus comprising:

a liquid container retaining unit according to claim 2; and a liquid ejecting head being capable of ejecting a liquid supplied from the liquid container retained in the liquid container retaining unit.

6. A liquid ejecting apparatus comprising:

a liquid container retaining unit according to claim 1; and a liquid ejecting head being capable of ejecting a liquid supplied from the liquid container retained in the liquid container retaining unit.

* * * * *